US006462295B1

(12) United States Patent
Knobloch et al.

(10) Patent No.: US 6,462,295 B1
(45) Date of Patent: Oct. 8, 2002

(54) HIGH-VOLTAGE POWER CIRCUIT BREAKER COMPRISING AN INSULATING NOZZLE

(75) Inventors: Hartmut Knobloch, Berlin (DE); Heinz-Helmut Schramm, Berlin (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 09/889,606

(22) PCT Filed: Jan. 19, 2000

(86) PCT No.: PCT/DE00/00179

§ 371 (c)(1),
(2), (4) Date: Jul. 19, 2001

(87) PCT Pub. No.: WO00/44010

PCT Pub. Date: Jul. 27, 2000

(30) Foreign Application Priority Data

Jan. 20, 1999 (DE) ..... 199 02 835

(51) Int. Cl.[7] ..... H01H 33/18

(52) U.S. Cl. ..... 218/48; 218/43; 218/53; 218/54

(58) Field of Search ..... 218/1, 43, 50, 218/51–54, 62–64, 66, 72, 73

(56) References Cited

U.S. PATENT DOCUMENTS

| | | | | |
|---|---|---|---|---|
| 4,420,662 A | * | 12/1983 | Niemeyer et al. | 218/53 |
| 5,006,679 A | * | 4/1991 | Thornton | 218/1 |
| 5,478,980 A | | 12/1995 | Freeman et al. | |
| 5,654,532 A | | 8/1997 | Meyer et al. | |

FOREIGN PATENT DOCUMENTS

| | | |
|---|---|---|
| DE | 30 44 836 A1 | 5/1982 |
| EP | 0 089 524 | 9/1983 |
| FR | 2 623 657 | 5/1989 |

* cited by examiner

*Primary Examiner*—Lincoln Donovan
*Assistant Examiner*—M. Fishman
(74) *Attorney, Agent, or Firm*—Morrison & Foerster LLP

(57) ABSTRACT

In a high-voltage power breaker having two rated current contact pieces and two arc contact pieces as well as an insulating nozzle, a filling body is provided, which is mounted on this insulating nozzle, surrounds the insulating nozzle in an annular shape and is composed of an electrically insulating material having a high dielectric constant, in order to influence the electric field in the isolating gap.

8 Claims, 2 Drawing Sheets

HIGH-VOLTAGE POWER CIRCUIT BREAKER COMPRISING AN INSULATING NOZZLE

Figure 1:
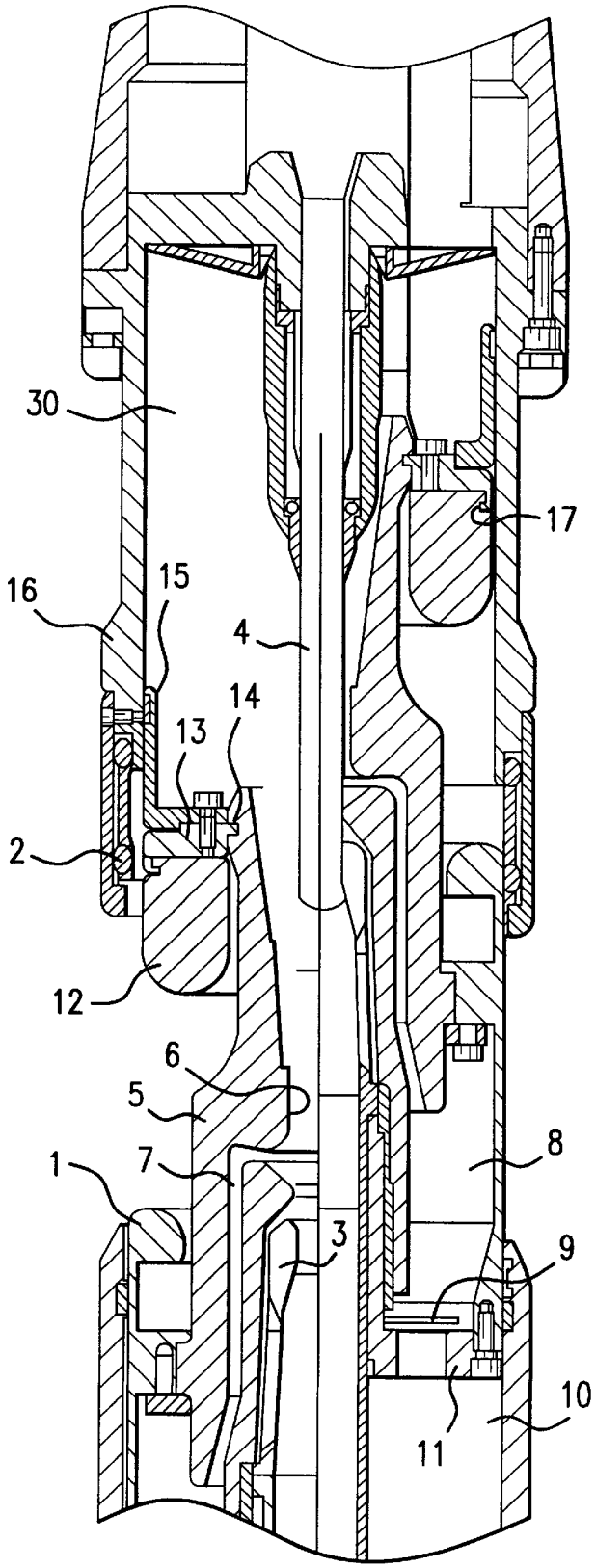

The invention relates to a high-voltage power breaker having a first and a second rated current contact piece, which are coaxially opposite one another, and having a first and a second arc contact piece, which are likewise coaxially opposite one another, in which case at least the first rated current contact piece and the first arc contact piece which is associated with it can be driven, and in which case the first arc contact piece is connected to an insulating nozzle for blowing out an arc which is struck between the two arc contact pieces, which insulating nozzle projects, at least partially in the disconnected state, into the isolating gap between the first rated current contact piece and the first arc contact piece on the one hand, and between the second rated current contact piece and the second arc contact piece on the other hand.

Such a high-voltage power breaker is known, for example, from U.S. Pat. No. 5,478,980 and U.S. Pat. No. 5,654,532.

In the known embodiments of high-voltage power breakers, a contact pin projects into the nozzle, and blocks it, in the connected state. During the disconnection process, the nozzle is moved together with the first arc contact and the first rated current contact, so that the constriction of the nozzle by the arc contact, which is in the form of a pin, is released.

In the disconnected state, the insulating nozzle bridges the isolating gap and in each case has a field electrode in the form of an annular body at its free end, which metal body makes electrically conductive contact, by means of a sliding contact, on the contact side of the second arc contact piece and of the second rated current contact piece.

In this way, the respective annular shielding body forms a field electrode in the disconnected state, which field electrode limits the isolating gap on the side of the second rated current contact, and shields the contact arrangement.

The aim of this is to control the electric field in the area of the isolating gap in such a manner that no excessive field loads can occur on the contact pieces.

The present invention is based on the object of providing field control in the area of the isolating gap using physically simple means and at a low price.

According to the invention, the object is achieved by the insulating nozzle having an annular filling body, which is attached detachably on its outer circumference and is composed of an insulating material having a dielectric constant $\epsilon_r>1$, in particular $\epsilon_r>3$.

A filling body such as this, which is composed of an insulating material having a dielectric constant which is greater than that of the insulating gas, makes the electric field between the contact pieces uniform in such a manner that the contact pieces themselves, in particular the arc contact pieces and especially the second arc contact piece, are dielectrically relieved of the load.

This is not done by providing equipotential surfaces, as would be the situation as a result of the geometry of a field electrode according to the prior art, but by the capability to influence the lines of force by the difference between the dialectric constant of the insulating gas on the one hand and that of the filling body on the other hand.

One advantage over the use of a field electrode is that the filling body does not need to be brought into electrical contact. Electrical contact, as is normal in the case of field electrodes, would be pointless since the filling body is not conductive.

A further advantage of a filling body which is detachably attached to the circumference of the insulating nozzle is that the insulating nozzle can itself be produced in slimline form, such that it is simple to fit in the interrupter unit. This is particularly important if the insulating nozzle is to be pushed in through a narrow opening during assembling, to the edge of which opening it is attached by means of a step on the insulating nozzle. Since the diameter of the filling body is larger than that of the insulating nozzle, it would be virtually impossible to fit the insulating nozzle with a filling body arranged in a fixed manner on it.

The configuration according to the invention allows the insulating nozzle to be fit first of all, with the filling body being fit on it later, during the assembly process.

A further advantage of a filling body composed of insulating material over a field electrode is that the filling body can be produced from a lightweight material, thus keeping down the mass to be accelerated during operation of the power breaker.

Further advantageous refinements of the invention are described in the dependent claims.

Figure 2:
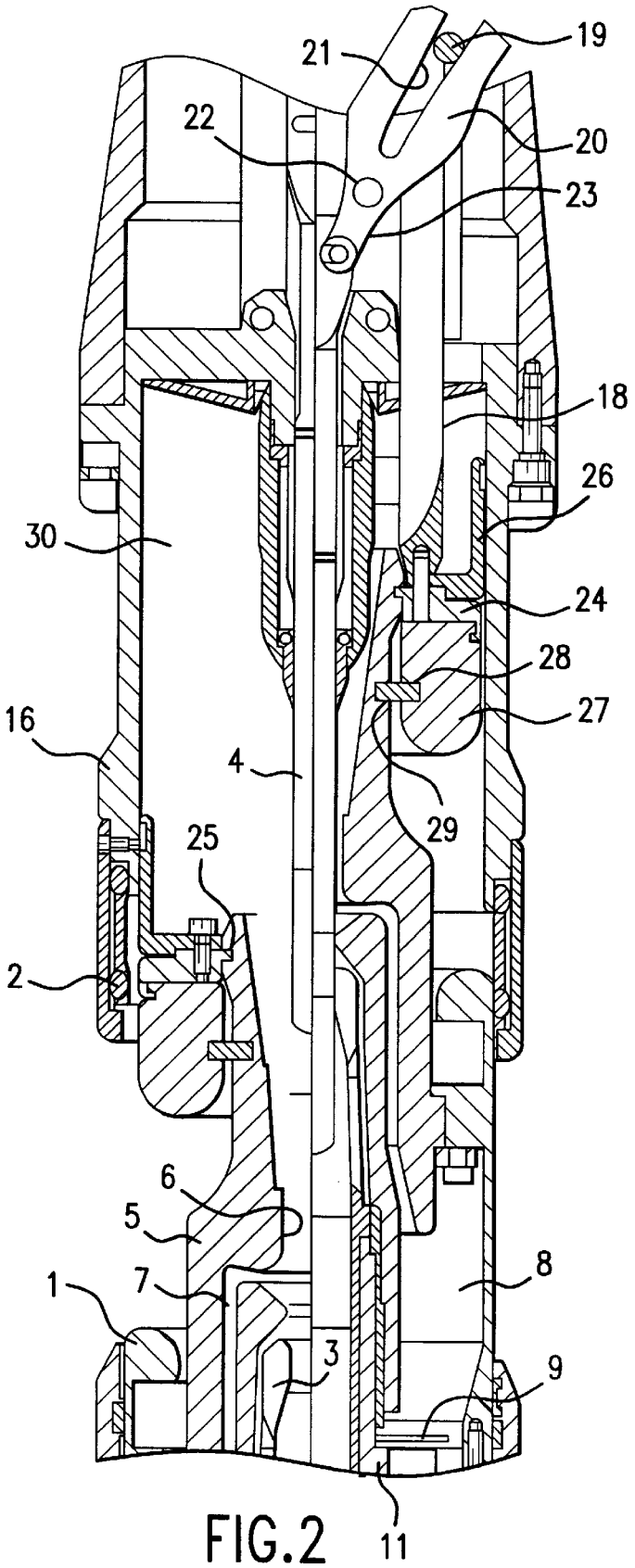

In the following text, the invention will be illustrated on the basis of an exemplary embodiment in the drawing, and will then be described. In the drawing:

FIG. 1 shows a schematic longitudinal section of a part of a interrupter unit of a high-voltage power breaker having a fixed second arc contact piece, and FIG. 2 shows a similar high-voltage power breaker to that in FIG. 1 but with a second arc contact piece which can be driven.

FIG. 1 illustrates an interrupter unit of a high-voltage power breaker having a first rated current contact piece 1, a second rated current contact piece 2, a first arc contact piece 3 and a second arc contact piece 4, in the form of a pin.

The first rated current contact piece 1 and the first arc contact piece 3, which is tulip-shaped, are connected to one another and can be driven jointly by means of a drive, which is not illustrated in any more detail.

The left-hand half of the figure shows the disconnected position of the interrupter unit, and the right-hand half shows its connected position.

As can be seen, in the connected state, the first rated current contact piece 1 is engaged with the second rated current contact piece 2, and the first arc contact piece 3 is also engaged with the second arc contact piece 4.

The first rated current contact piece 1 and the first arc contact piece 3 are also connected to an insulating nozzle 5, which can thus likewise be driven.

In the connected state, a nozzle constriction 6 is blocked by the second arc contact piece 4.

During the disconnection process, the first rated current contact piece, the first arc contact piece 3 and the insulating nozzle 5 are moved downward in the illustration shown in FIG. 1, with the rated current contact pieces 1, 2 being disconnected from one another first of all, followed by the arc contact pieces 3, 4.

Once the arc contact pieces 3, 4 have been disconnected from one another, an arc is normally struck between them, and this arc is fed by the alternating current that is to be switched.

The interrupter unit of the high-voltage power breaker has an encapsulation enclosure which surrounds the interrupter unit illustrated in FIG. 1 but which is not illustrated and is filled with an insulating gas, normally $SF_6$. This insulating gas also fills the arcing area between the arc contact pieces 3, 4, and may be heated by the arc produced there.

The insulating gas can then flow away through the annular channel 7 in the insulating nozzle 5 into a heating area 8, which is separated from an additional compression area 10 by a non-return valve 9. If the current densities are relatively low, the compression area may be used for mechanical compression of the insulating gas by virtue of the movement of the piston 11 which is connected to the first arc contact piece 3, so that a specific minimum insulating gas pressure is always available.

Normally, when disconnecting a short-circuit current, the heating of the insulating gas and the expansion, associated with this, in the arcing area due to the arc are, however, sufficient to store sufficient insulating gas at high pressure in the heating area 8 to prevent the arc from restriking, with this insulating gas flowing back through the annular channel 7 to the arcing area when the arc is briefly quenched during the current zero crossing, and cooling the isolating gap there.

At this time, the insulating nozzle 5 has moved onward to such an extent that the second arc contact piece 4 no longer blocks the nozzle constriction 6, and the insulating gas can flow away past the second arc contact piece 4 into an expansion area 30.

In the disconnected state, there is an isolating gap between the first rated current contact 1 and the second rated current contact 2, and between the arc contact piece 3 and the second arc contact piece 4.

In the disconnected state, the insulating nozzle 5 bridges this isolating gap. It is composed of a material having a very high electrical resistance, so that there is no need to be concerned about any interference with the isolation capability in the isolating gap.

For use at very high voltages, the overall contour on both sides of the isolating gap must as far as possible be controlled such that the electrical field strength does not become excessive at specific points which are at particular risk dielectrically. According to the invention, the electric field is influenced by the filling body 12, which, for example, is composed of casting resin which is filled with barium titanate, to give an overall dielectric constant of $\epsilon_r$=10. The filling body 12 is detachably attached to the end of the insulating nozzle 5 by means of a ring 13 in a groove 14. In the disconnected state, it projects into the isolating gap.

There is no electrically conductive connection between the filling body and the second rated current contact 2, but only a component 15 which seals the space between the insulating nozzle 5 and the rated current contact support 16, in order to prevent the insulating gas from escaping at this point.

The ring 13 consists of two half rings, which engage on the one hand in a groove 17 in the filling body 12 and on the other hand in the groove 14 in the insulating nozzle 5, and which are connected to one another in the circumferential direction during the assembly process. The filling body is thus connected to the insulating nozzle 5.

In FIG. 2, all those parts which are of the same design as those in FIG. 1 are provided with the same reference symbols.

The method of operation of the interrupter unit illustrated in FIG. 2 is in principle similar to that of the interrupter unit illustrated in FIG. 1, with the difference that the second arc contact piece 4 shown in FIG. 2 is switched such that it can be driven. The right-hand half of the figure shows the arc contact piece 4 in the connected state, in which it has been moved into the tulip-shaped first arc contact piece 3.

During the disconnection process, the first arc contact piece 3, the first rated current contact piece 1 and the insulating nozzle 5 are moved downward, with the movement of the insulating nozzle 5 driving a coupling rod 18 which is coupled to it and which, by means of a bolt 19, moves a fork-shaped lever 20 which has a slotted track 21. The lever 20 is in this case pivoted clockwise about the fixed bearing point 22, and its second lever arm 23 drives the second arc contact piece 4, which is in the form of a pin. In consequence, the second arc contact piece 4 is moved in the opposite direction to the first arc contact piece 3.

The coupling rod 18 is mounted by means of a ring 24 on the insulating nozzle 5, and this ring 24 engages in a groove 25 in the insulating nozzle 5. The ring 24 consists of two half-rings, which are inserted into the groove 25 and are attached to one another. The coupling rod 18 is attached to the ring 24 by means of a screw connection. A guide body 26 is also attached to the ring, and is used to guide the insulating nozzle in the contact piece support 16.

The filling body 27 is mounted, separately from the ring 24 by means of a further ring 28 in a further groove 29 in the insulating nozzle. The ring 29 is also split in the circumferential direction, and can thus be fitted onto the insulating nozzle 5 in two halves. At the same time, the ring 28 engages in a circumferential groove on the inside of the filling body 27, and thus fixes the filling body 27 on the insulating nozzle.

A gap is maintained between the filling body 27 and the insulating nozzle 5 in order to avoid the formation of interspaces or triple points, at which two different materials and the insulating gas meet. This reduces the dielectric problems in this area.

In the disconnected state, the filling body assumes the position illustrated in the left-hand half of FIG. 2, thus resulting in the desired configuration of the electric field in the isolating gap. The first rated current contact piece 1 in this switch position forms an electrode which, opposite the filling body, likewise has positive influence on the electric field in the isolating gap.

What is claimed is:

1. A high-voltage power breaker, comprising:

a first and a second rated current contact piece which are coaxially opposite one another; and a first and a second arc contact piece which are coaxially opposite one another, wherein at least the first rated current contact piece and the first arc contact piece associated therewith can be driven, and the first arc contact piece is connected to an insulating nozzle to blow out an arc which is struck between the two arc contact pieces, which insulating nozzle projects, at least partially in the disconnected state, into the isolating gap between the first rated current contact piece and the first arc contact piece and between the second rated current contact piece and the second arc contact piece, the insulating nozzle has an annular filling body, which is removably attached on its outer circumference and is composed of an insulating material having a dielectric constant.

2. The high-voltage power breaker as claimed in claim 1, wherein the filling body is composed of casting resin.

3. The high-voltage power breaker as claimed in claim 2, wherein the casting resin is filled with barium titanate.

4. The high-voltage power breaker as claimed in claim 1, wherein the filling body is configured to be rounded in the radially running cross section.

5. The high-voltage power breaker as claimed in claim 1, wherein the insulating nozzle has an annular groove for attachment of the filling body.

6. The high-voltage power breaker as claimed in claim 1, wherein the second arc contact is configured to be driven.

7. The high-voltage power breaker as claimed in claim 6, wherein the second arc contact piece is configured to be driven by a transmission element, which is attached to the insulating nozzle, and a direction-changing drive.

8. The high-voltage power breaker as claimed in claim 1, wherein the second arc contact piece is formed as a pin.

* * * * *